US005306175A

United States Patent [19]

Swanstrom

[11] Patent Number: 5,306,175

[45] Date of Patent: Apr. 26, 1994

[54] ELECTRICAL CONNECTOR PANEL FASTENER

[75] Inventor: Kenneth A. Swanstrom, Doylestown, Pa.

[73] Assignee: Penn Engineering & Manufacturing Corp., Danboro, Pa.

[21] Appl. No.: 51,337

[22] Filed: Apr. 23, 1993

[51] Int. Cl.[5] ..... H01R 13/627

[52] U.S. Cl. ..... 439/362; 439/564

[58] Field of Search ..... 439/362, 359, 361, 562, 439/564, 565, 571, 572, 681, 573

[56] References Cited

U.S. PATENT DOCUMENTS

| | | | |
|---|---|---|---|
| 3,040,289 | 6/1962 | Wicks | 439/564 |
| 5,088,935 | 2/1992 | Dise et al. | 439/564 |
| 5,158,474 | 10/1992 | Frantz | 439/362 |

FOREIGN PATENT DOCUMENTS

| | | | |
|---|---|---|---|
| 0465774 | 9/1928 | Fed. Rep. of Germany | 439/813 |
| 0733024 | 3/1943 | Fed. Rep. of Germany | 439/813 |

*Primary Examiner*—Larry I. Schwartz
*Assistant Examiner*—Hien D. Vu
*Attorney, Agent, or Firm*—Gregory J. Gore

[57] ABSTRACT

An improved electrical connector panel standoff fastener includes a panel-mounted stud with an affixed cap nut which is captive within the cable end connector shell. The stud includes a knurled head which is pressed into the chassis panel from the inside out. The stud includes a knurled head sized so that excessive bulging of the panel cutout does not occur upon pressing the stud into the panel. The desired standoff height is maintained by an end wall within the cap nut which acts as a screw stop. Also, the stud may be internally threaded to receive a screw from the opposite side of the panel to fasten the connector receptacle to the panel. The invention may further include a locking device such as a plug inserted into the threads of the stud.

10 Claims, 2 Drawing Sheets

FIG. 3
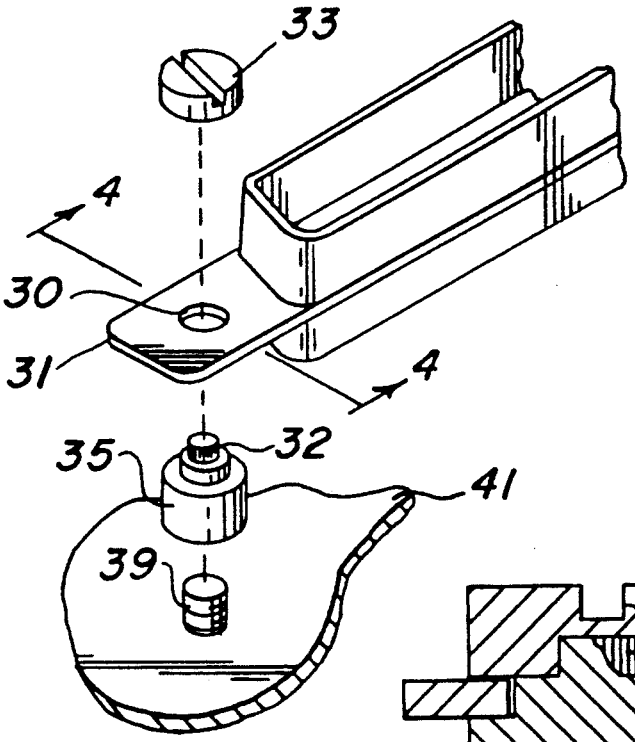
FIG. 4
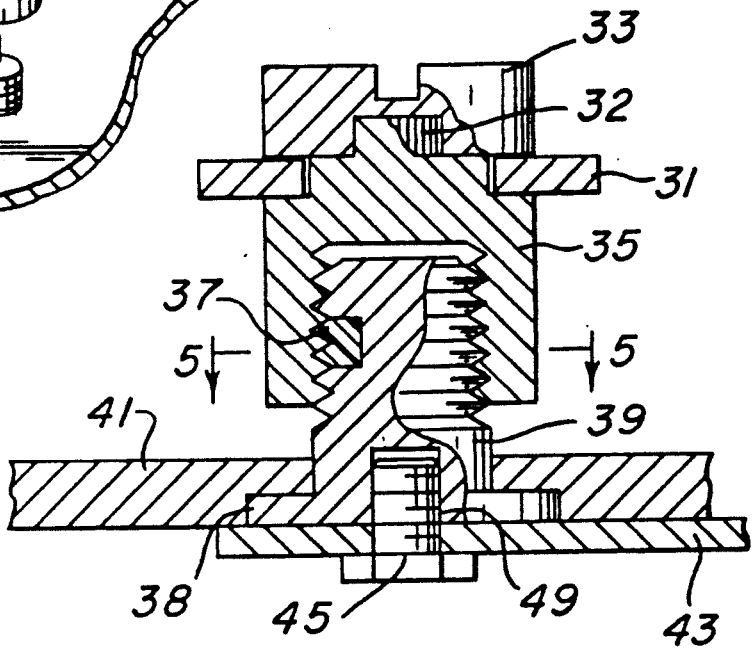
FIG. 5
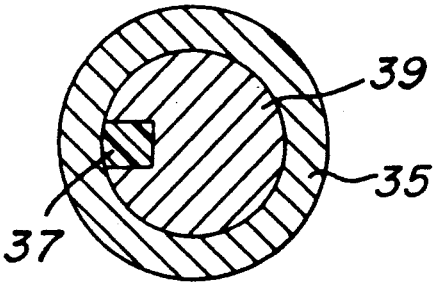
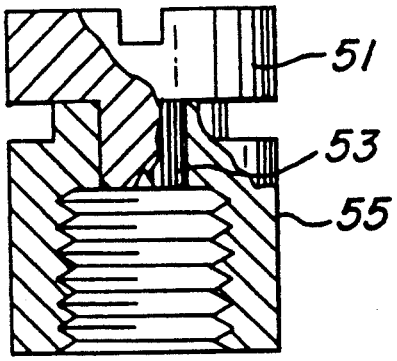
FIG. 6

ELECTRICAL CONNECTOR PANEL FASTENER

FIELD OF THE INVENTION

This invention relates to electrical cable connectors which fasten to the outer chassis of electrical equipment, such as workstations and computer terminals. More specifically, it relates to an electrical connector junction chassis panel having permanently installed fastener means. This invention is closely related to the devices disclosed in U.S. Pat. No. 5,088,939 (hereinafter "Dise et al connector") which is commonly owned with this application.

BACKGROUND OF THE INVENTION AND DESCRIPTION OF PRIOR ART

Electrical equipment in the computer and electrical component industries utilizes loose hardware, comprising internally and externally-threaded standoffs (known as "female screw locks"), in addition to spacer washers, lock washers, and nuts to attach data receptacles to the equipment chassis; and further, the data plug to the receptacle. FIG. 1 shows a typical assembly of parts found at the rear of the chassis for connecting incoming and outgoing data cables. These data cables may be comprised solely of electrical contacts, fiber optic terminals, air connectors, or any combination of the foregoing.

These data plugs and receptacles typically have a modified, elongated "D" shape to ensure proper orientation in their mounting holes and also proper orientation with the mounting plugs. Such connectors have become known as "D" connectors, and due to the relatively small size, more typically known as "D subminiature", or "D-sub" connectors. Shell sizes, pin configuration, and mounting holes have been standardized throughout the world and all manufacturers meet these standards. In addition, many manufacturers have their own proprietary plug/receptacle configurations developed to meet customer's special applications.

In almost all cases, however, the matter of loose hardware was never addressed, nor was the present volume of consumption of such connectors anticipated. Thus, the industry continues to attach connectors to chassis and plugs with conventional loose hardware, in spite of the high labor costs associated with manually assembling this hardware.

Currently, in the connector industry the number of contact circuit pair in a D-sub connector may range from 9 to 50 contacts, with a typical connect/disconnect force of 12-ounces per contact pair, thus, for the maximum number of contact pairs, this connect/disconnect force is approximately 600-ounces or 37 pounds. Technology is moving toward increasing this density to 100 contact pairs, and as the need for higher electrical current density increases, the connect/disconnect forces will also increase. Therefore, there is a need in the art for electrical cable connector fasteners which can provide a higher connect/disconnect force than is currently available. Meeting this need is difficult because with the standardized D-sub connector configuration, there are space limitations which prohibit simply increasing the dimensions of the fasteners. In a D-shaped electrical connector panel, there is very limited space between the edge of the D-shaped cutout in the panel, and the center line of the fastening screw.

Due to the adoption of manufacturing standards mentioned above, such assembly screws either have 4-40 Unified, or M3 metric threads. These small diameter screws may be used for both pulling in, or jacking out, the plug from the receptacle and are suitable only for connectors having a limited number of contacts. As the need for high density (more numerous) and greater power (larger) connectors are needed, these small diameter screws are not strong enough to engage or disengage such higher density connectors.

SUMMARY OF THE INVENTION

The above-mentioned Dise et al connector cannot be enlarged to increase the connect/disconnect force as desired because of the space limitations mentioned above. Therefore, even though this improved system eliminates loose hardware, it cannot solve the problem of the limited torque that can be applied to the plug fastening screws. The connect/disconnect force problems with the designs discussed above have been overcome by the present invention which provides a novel and unobvious improvement over the prior art.

According to the invention, the mounting structure of the prior art has been improved by replacing the female part of the connector with a threaded male stud. The threaded stud cooperates with a ca nut which is captive within the cable end connector shell. The desired standoff height is maintained by the end wall within the cap nut which acts as a screw stop. This new structure permits a 4-40 thread to be replaced with an 8-32 thread within the same space. Increasing the diameter of the mating fasteners from the 4-40 to 8-32 size increases the potential connect/disconnect force from 170 pounds to 500 pounds. (This calculation is based on a safety factor of 60% of the 600 ksi torque-tension relationship of a 8-32 mild steel screw.) Surprisingly, not only has this improvement provided the desired additional connecting force, but it has also yielded other significant advantages.

More specifically described, the present invention utilizes a threaded self-clinching standoff stud which is installed through a mounting hole in the chassis panel from the inside out. The stud includes a knurled head sized so that excessive bulging of the panel cutout does not occur upon pressing the standoff into the panel. The head of the standoff stud is pressed flush with the inside surface of the panel to which the receptacle portion of the connector is fastened. The stud threadably engages a cap nut which is captive in the plug connector shell. When fully engaged, the end face of the standoff stud bottoms out against the interior end wall of the nut which is attached to the connector plug shell. These cooperating structures function as a dimensionally stable spacer to ensure the correct extent of engagement between the connector plug pins and the plug receptacle. Also, the stud may be internally threaded to receive a screw from the opposite side of the panel to fasten the connector receptacle to the panel. The invention may further include a locking device, such as a Nylon(R) plug inserted into the external threads of the stud. In other embodiments, novel means for captivating the cap nut in the connector shell are also provided.

It is therefore a primary object of the present invention to devise a fastening system for electrical connector plugs and receptacles which provide an increased connect/disconnect force. It is a further object of the invention to provide high force attachment means for electrical connector receptacles which is inexpensive to manufacture and easy to install. It is yet another object of the present invention to include a self-locking device in an improved high force electrical connector fastening system. Other objects and advantages of the invention will become apparent from the following detailed description of the invention when considered in conjunction with the accompanying drawings.

BRIEF DESCRIPTION OF THE DRAWINGS

FIG. 3 is an exploded top front isometric view of an alternate embodiment of the present invention.

FIG. 4 is side sectional view taken from FIG. 3 as shown in that figure.

FIG. 5 is top sectional view taken from FIG. 4.

FIG. 6 is a partial cutaway view of the alternate embodiment shown in FIG. 5.

DESCRIPTION OF THE PREFERRED EMBODIMENT

Figure 1:
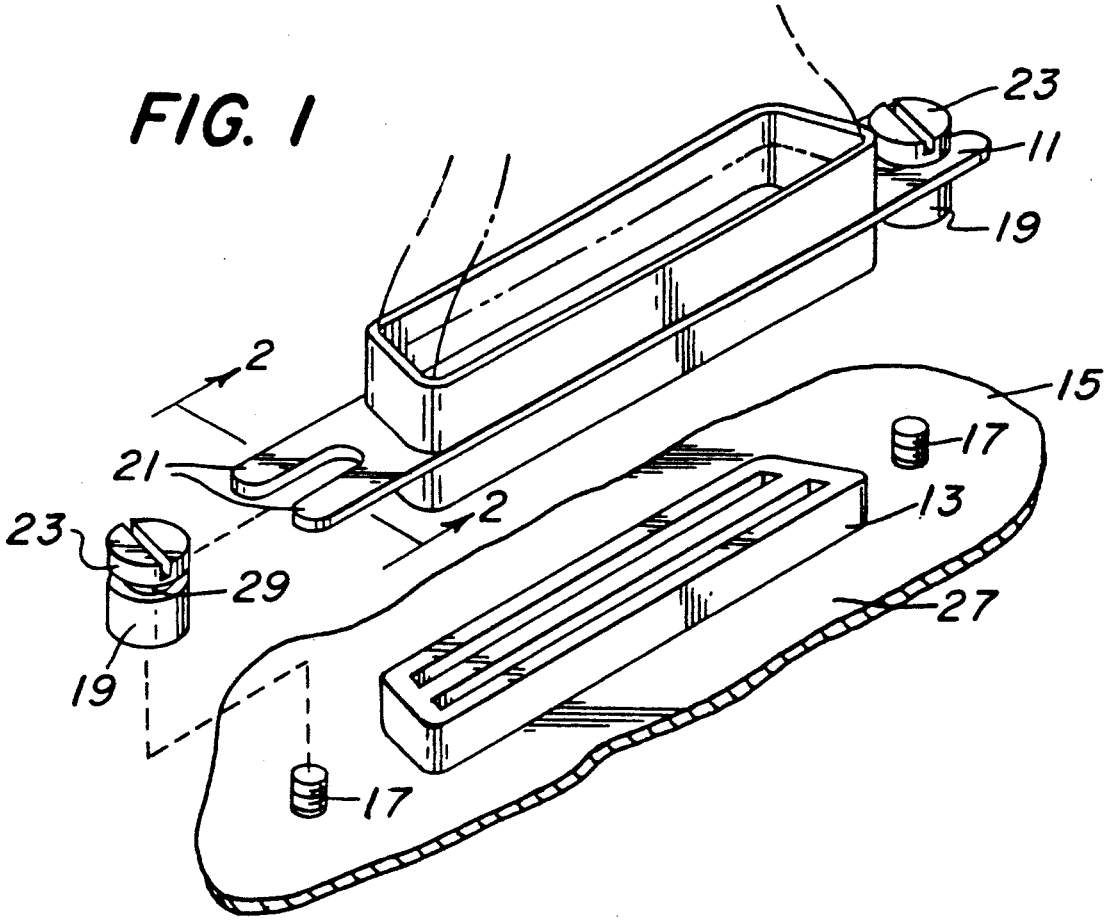
FIG. 1 is a top front isometric view of the connector plug shell and plug receptacle assembly.

Referring now to FIG. 1, a typical D-subconnector plug is shown in relation to the plug receptacle and mounting panel utilizing the present fastening system. The data cable is shown lined in phantom. In this embodiment, the connector shell 11 includes mounting ears 21 on opposite lateral sides of the plug. The ears are formed by slots located in the laterally extending tabs of the plug connector shell. Right-side and left-side cap nuts 19 fit into the ears and axially captivate the connector plug shell by way of an annular groove 29 along the outside of the nut. The cap nuts threadably engage cooperating self-clinching mounting studs 17 which are in turn mounted to panel 15 as will be more further described herein. Receptacle 13 which receives the mounting plug in its assembled condition is affixed to panel 15.

Figure 2:
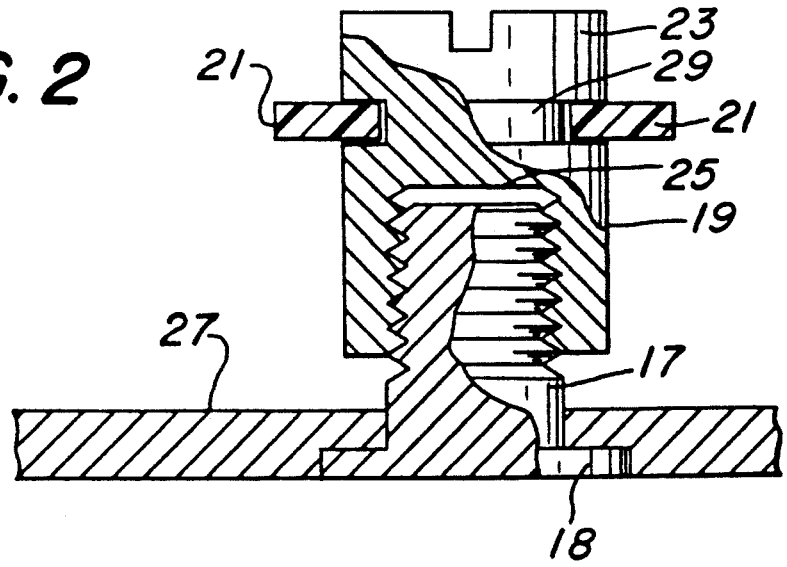
FIG. 2 is a side sectional view of the connector plug shell shown in FIG. 1 mounted to the receptacle panel using the fastener of the present invention.

Referring now to FIG. 2, each cap nut 19 shown in FIG. 1 includes an annular groove 29 and a head 23. Ears 21 of the connector plug shell are axially captive within groove 29 of the cap nut. A self-clinching mounting stud 17 is press- fit through a hole in the panel. Stud 17 is installed into panel 27 from the inside out with a self-clinching head 18 pressed into the panel so that it is flush with the inside surface. The cap nut further includes end wall 25 at the end of the blind threaded hole, and acts as a stop which bottoms out against the top of the threaded stud 17 when the nut is fully tightened. Hence, the nut holds the connector plug shell a fixed distance from the panel determined by the dimensions of the cap nut and mounting stud. Thus, when the cap nut is turned down against the top of the stud, the connector plug will be inserted into the receptacle the correct distance.

Referring now to FIG. 3, an exploded view of an alternate embodiment of the present invention is shown. In this application, connector plug shell 31 includes circular mounting hole 30 replacing the mounting ears of the embodiment depicted in FIGS. 1 and 2. As shown in this figure, the cap nut is a two-piece assembly with the head 33 separable from the body 35 of the nut at the top of the external groove. Stud 39 is affixed to panel 41 as shown in FIG. 2.

FIG. 4 shows greater detail of the embodiment shown in FIG. 3 when assembled. Cap nut 35 includes a separate head 33 having a recess on its underside to receive pin 32 which extends from the top of the cap nut. After the connector plug shell 31 is positioned on top of the body of the cap nut 35 in alignment with the mounting hole, head 33 is pressed onto pin 32 and thus the assembled nut is positively captivated to the connector shell. The cap nut shown in this figure also includes an interior end wall which functions in the same way with the mounting panel as the equivalent structures described in FIGS. 1 and 2.

The embodiment shown in FIG. 4 further includes locking plug 37 which is a separate insert well-known in the fastening arts which may be inserted into the threads of the stud to provide a locking feature which prevents unwanted loosening of the nut. The stud in this embodiment further includes a female blind hole 49, which is internally threaded to receive screw 45 from the inside of the panel 41. The additional screw means 45 may be employed to secure the plug receptacle shell 43 against the inside of panel 41. By these relations, it should be readily understood that a given nut and stud pair will provide the same positive spacing between the plug shell 31 and the receptacle shell 43 regardless of the thickness of the mounting panel 41 to which the fastening assembly is applied. FIG. 5 is a top sectional view taken from FIG. 4 as shown in that figure and shows locking plug 37 providing added frictional contact between the body of the cap nut 35 and the threaded shank of the mounting stud 39.

FIG. 6 shows yet another embodiment of the present invention in which the cap nut is also of two-piece construction similar to the embodiment shown in FIG. 4, except that the male/female engagement features between the body of the cap nut 55 and the head 51 have been reversed. In this embodiment, the head of the nut includes pin 53 which is received in a hole in the top of the body of the nut.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A system for fastening together a cable connector plug, a panel, and a cable receptacle, comprising:
   - a flat panel;
   - a connector plug located on a front side of said panel and having attachment means parallel to said panel at opposite right and left lateral sides of said plug;
   - a connector receptacle at a rear of said panel protruding through an aperture in said panel, said connector receptacle affixed to said panel and in mating relationship with said connector plug;
   - a self-clinching, threaded stud inserted through a hole in said panel from the rear and affixed thereto; and
   - a headed cap nut threadably engaged with said stud, said nut having a lateral groove along an outside surface which captively retains said attachment means of said connector plug located therein.

2. The fastening system of claim 1, wherein said cap nut further includes an interior end wall which acts as, a stop when said end wall abuts an end of said stud, a stop holding said cap nut above a front surface of said panel when said nut is fully engaged.

3. The fastening system of claim 2, wherein said stud includes a head which is pressed flush with a rear side of said panel.

4. The fastening system of claim 3, wherein said attachment means are slots located in laterally extending tabs of a cable connector plug shell.

5. A system for fastening together a cable connector plug, a panel, and a cable receptacle, comprising:

a flat panel;

a connector plug located on a front side of said panel and having attachment means parallel to said panel at opposite right and left lateral sides of said plug;

a connector receptacle at a rear of said panel protruding through an aperture in said panel, said connector receptacle affixed to said panel and in mating relationship with said connector plug;

a self-clinching, treaded stud inserted through a hole in said panel from the rear and affixed thereto; and a headed cap nut threadably engaged with said stud, a body of said nut being cylindrical and having an area of reduced diameter directly beneath a head of the nut which captively retains connector plug attachment means located therein.

6. The fastening system of claim 5, wherein said cable connector attachment means are holes located in opposing lateral tabs of a cable connector shell.

7. The fastening system of claim 6, wherein the head of said cap nut is a separate element releaseably affixed to the top of said cap nut.

8. The fastening system of claim 7, further including a thread-locking plug inserted into the side of a threaded shank of said stud.

9. The fastening system of claim 8, further including a receptacle shell abutting a rear surface of said panel and affixed thereto by screw means threadably engaged with a threaded hole in said stud.

10. The fastening system of claim 9, wherein said head of said cap nut is affixed to the body of said cap nut by way of a press-fit attachment between a center pin in the body of the cap nut, and a mating hole in said head.

* * * * *